US008657302B1

(12) United States Patent
Chen

(10) Patent No.: US 8,657,302 B1
(45) Date of Patent: Feb. 25, 2014

(54) SKATE SOLE ASSEMBLY

(75) Inventor: Tai-Heng Chen, Taipei (TW)

(73) Assignee: Minson Enterprises Co., Ltd., Taipei (TW)

( * ) Notice: Subject to any disclaimer, the term of this patent is extended or adjusted under 35 U.S.C. 154(b) by 0 days.

(21) Appl. No.: 13/590,498

(22) Filed: Aug. 21, 2012

(51) Int. Cl.
*A63C 17/02* (2006.01)

(52) U.S. Cl.
USPC ..... 280/11.231; 280/11.208; 280/11.27

(58) Field of Classification Search
USPC ..... 280/11.204, 11.208, 11.231, 11.27
See application file for complete search history.

(56) References Cited

U.S. PATENT DOCUMENTS

| | | | | | |
|---|---|---|---|---|---|
| 2,269,080 | A | * | 1/1942 | Coldwell et al. | 280/11.28 |
| 2,631,861 | A | * | 3/1953 | Daniska | 280/11.208 |
| 3,035,846 | A | * | 5/1962 | Asad | 280/11.208 |
| 3,862,763 | A | * | 1/1975 | Ware | 280/11.28 |
| 4,262,918 | A | * | 4/1981 | Sandino | 280/11.26 |
| 4,294,455 | A | * | 10/1981 | Krueger | 280/11.209 |
| 4,295,655 | A | * | 10/1981 | Landay et al. | 280/11.209 |
| 4,311,319 | A | * | 1/1982 | Snyder et al. | 280/11.28 |
| 4,312,514 | A | * | 1/1982 | Horowitz et al. | 280/11.204 |
| 4,328,627 | A | * | 5/1982 | Sanders | 36/115 |
| 4,345,774 | A | * | 8/1982 | Poe et al. | 280/11.209 |
| 4,392,659 | A | * | 7/1983 | Yoshimoto | 280/11.225 |
| RE32,346 | E | * | 2/1987 | Klamer et al. | 280/11.201 |
| D346,417 | S | * | 4/1994 | Chen | D21/763 |
| 5,326,115 | A | * | 7/1994 | Seltzer | 280/11.19 |
| 5,462,295 | A | * | 10/1995 | Seltzer | 280/11.19 |
| 6,679,505 | B2 | * | 1/2004 | Yang | 280/11.19 |
| 8,465,027 | B2 | * | 6/2013 | Burke | 280/11.27 |
| 2003/0197338 | A1 | * | 10/2003 | Chen | 280/11.224 |
| 2003/0201614 | A1 | * | 10/2003 | Chi | 280/11.3 |
| 2003/0209868 | A1 | * | 11/2003 | Weitgasser et al. | 280/11.27 |
| 2010/0295260 | A1 | * | 11/2010 | Trew | 280/11.204 |
| 2012/0248718 | A1 | * | 10/2012 | Miller | 280/11.27 |

* cited by examiner

*Primary Examiner* — Jeffrey J Restifo
(74) *Attorney, Agent, or Firm* — C. G. Mersereau; Nikolai & Mersereau, P.A.

(57) ABSTRACT

A skate sole assembly has a boot bracket, a frame, two cushioning bearings and two axles. The frame is mounted under the boot bracket and has an arcuate plate and two outer supporting arms. The arcuate plate has two inner supporting arms corresponding to the outer supporting arms. The cushioning bearings are embedded respectively in connecting ends of the outer supporting arms and respectively receive connecting ends of the inner supporting arms. Each axle is rotatably mounted through the connecting end of one inner supporting arm, the connecting end of one outer supporting arm and one cushioning bearing. The frame is made of rigid material to stabilize the motion of a user wearing skates which are assembled from the skate sole assemblies. The cushioning bearings provide a cushioning effect.

4 Claims, 8 Drawing Sheets

SKATE SOLE ASSEMBLY

BACKGROUND OF THE INVENTION

1. Field of the Invention

The present invention relates to a skate, and more particularly to a skate sole assembly that is vibration-proof, ensures a wearer can move stably and prevents rollers of the skate sole assembly from inadvertently shifting or deviating from an original path or accidentally skidding.

2. Description of Related Art

Conventional skates are classified into in-line skates, four-roller skates, three-roller skates, etc.

With reference to FIG. 8, a conventional skate sole assembly is mounted under a bottom of a boot and comprises a sole frame 90, two mounting bolts 901, two cushioning elements 91 and two axles 92.

The mounting bolts 901 extend from a bottom surface of the sole frame 90.

The cushioning elements 91 are substantially V-shaped and are mounted on the bottom surface of the sole frame 90 and correspond to the mounting bolts 901. Each cushioning element 91 is made of resilient material such as rubber and has a bearing 910, a mounting arm 911 and supporting arm 912. The bearing 910 has a through hole defined through the bearing 910. The mounting arm 911 is formed on and protrudes from the bearing 910 and has a connecting end connected to the bottom surface of the sole frame 90. The supporting arm 912 is formed on and protrudes from the bearing 910 and has a connecting end mounted around a corresponding bolt 901 through a fastener 902 such as a nut.

The axles 92 are mounted rotatably and respectively through the through holes of the bearings 910. Each axle 92 may be fitted with two wheels respectively on two opposite ends of the axle 92.

The skate sole assembly may be assembled with a boot to form a skate. When a user wears a pair of skates for athletic purposes, the V-shaped cushioning elements 91 provide cushioning effects to absorb and ease the vibration emanating from slightly uneven ground. However, the bearings 10, mounting arms 911 and supporting arms 912 of the V-shaped cushioning elements 91 required to be firm for supporting the axles are made of resilient material with insufficient rigidity. Therefore, a user wearing the skates assembled with the cushioning elements 91 easily skids when turning. During turning, the cushioning elements 91 easily deform and lower friction between the wheels and ground occurs so that the wheels probably skid and deviate from an original path and endanger the user.

To overcome the shortcomings, the present invention provides a skate sole assembly to mitigate or obviate the aforementioned problems.

SUMMARY OF THE INVENTION

The main objective of the invention is to provide a skate sole assembly that is vibration-proof, ensures a wearer can move stably and prevents rollers of the skate sole assembly from inadvertently shifting or deviating from an original path or accidentally skidding.

A skate sole assembly in accordance with the present invention has a boot bracket, a frame, two cushioning bearings and two axles. The frame is mounted under the boot bracket and has an arcuate plate and two outer supporting arms. The arcuate plate has two inner supporting arms corresponding to the outer supporting arms. The cushioning bearings are embedded respectively in connecting ends of the outer supporting arms and respectively receive connecting ends of the inner supporting arms. Each axle is rotatably mounted through the connecting end of one inner supporting arm, the connecting end of one outer supporting arm and one cushioning bearing. The frame is made of rigid material to stabilize the motion of a user wearing skates which are assembled from the skate sole assemblies. The cushioning bearings provide a cushioning effect.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
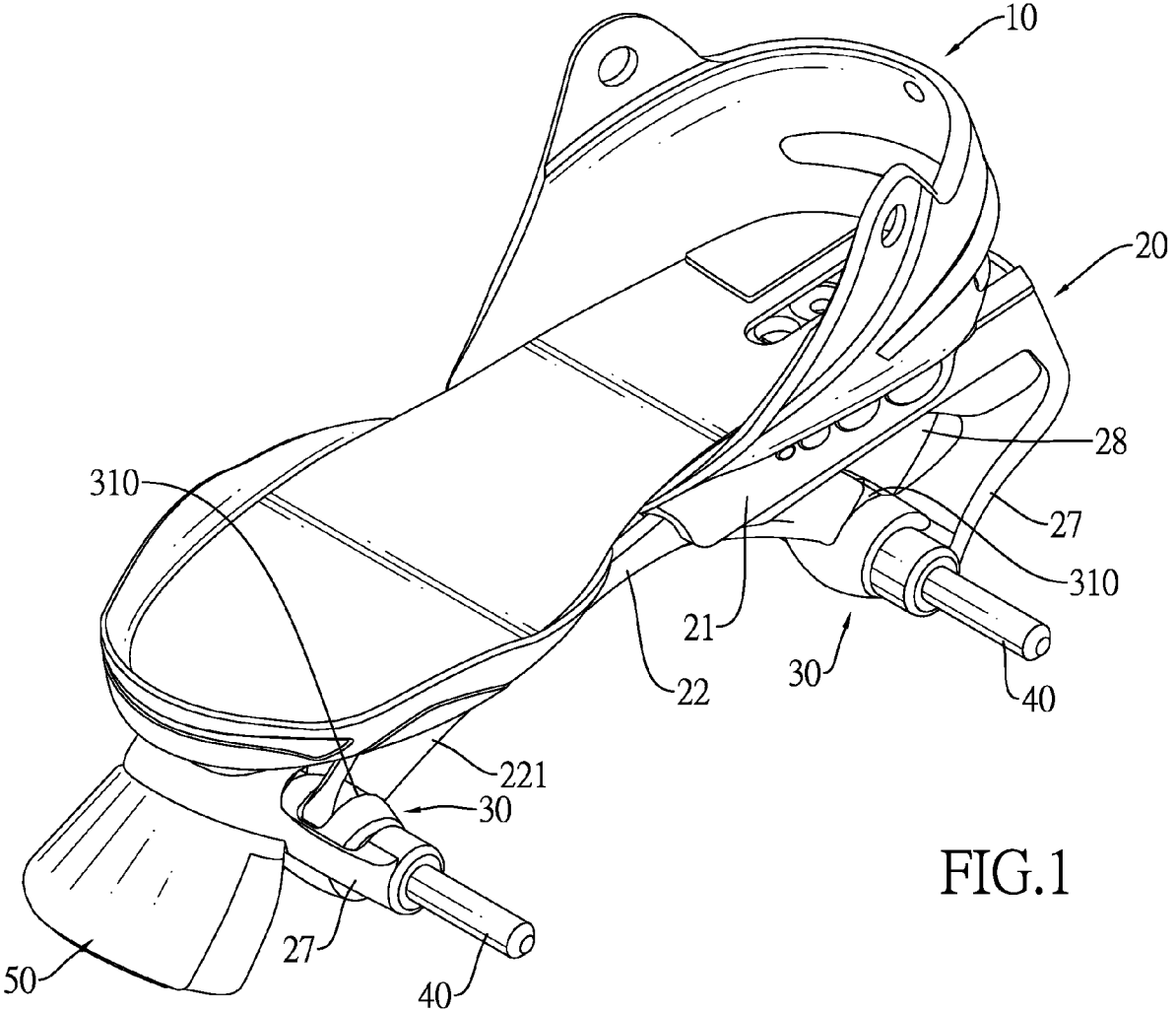
FIG. 1 is a perspective view of a skate sole assembly in accordance with the present invention.
Figure 2:
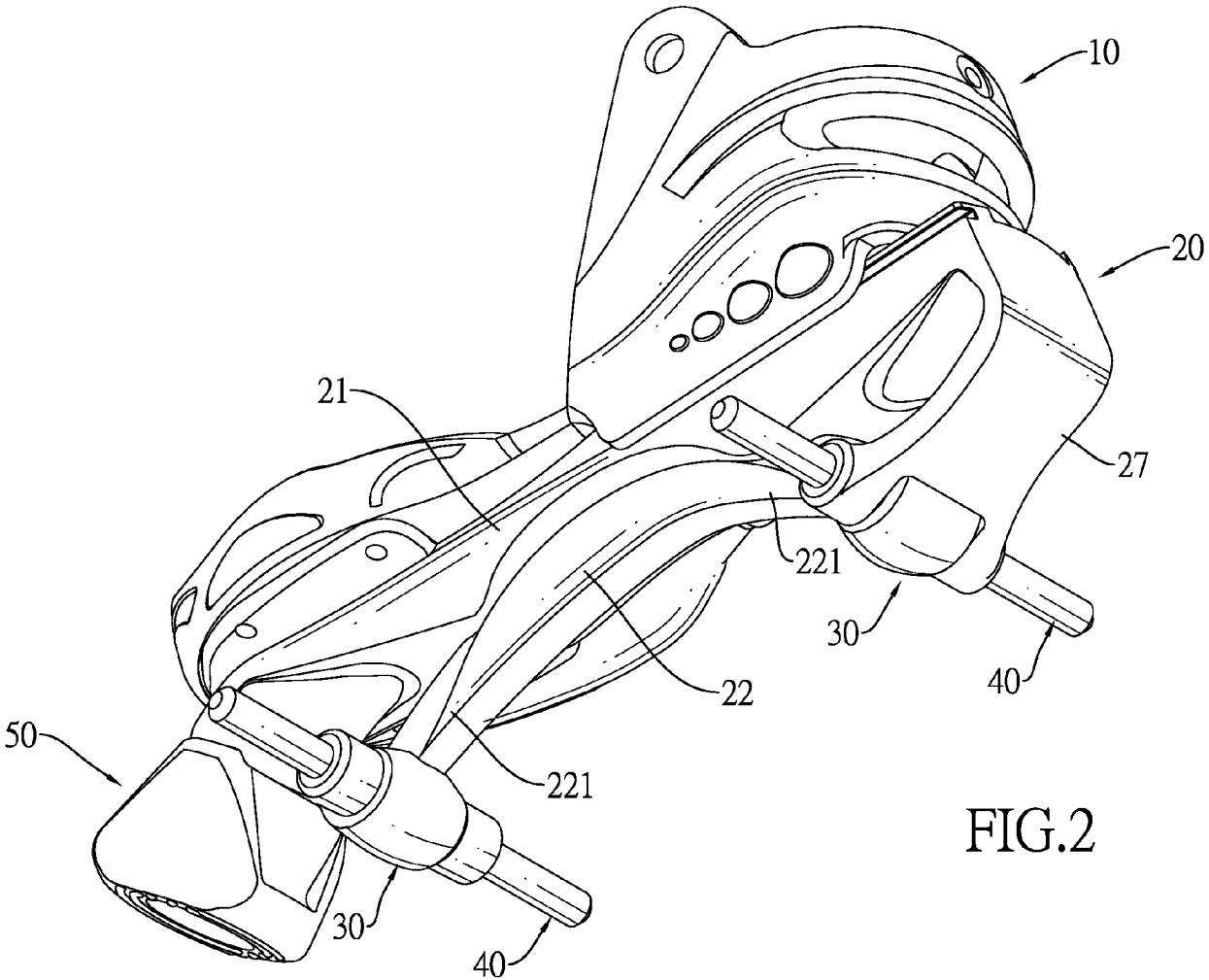
FIG. 2 is another perspective view of the skate sole assembly in FIG. 1.
Figure 3:
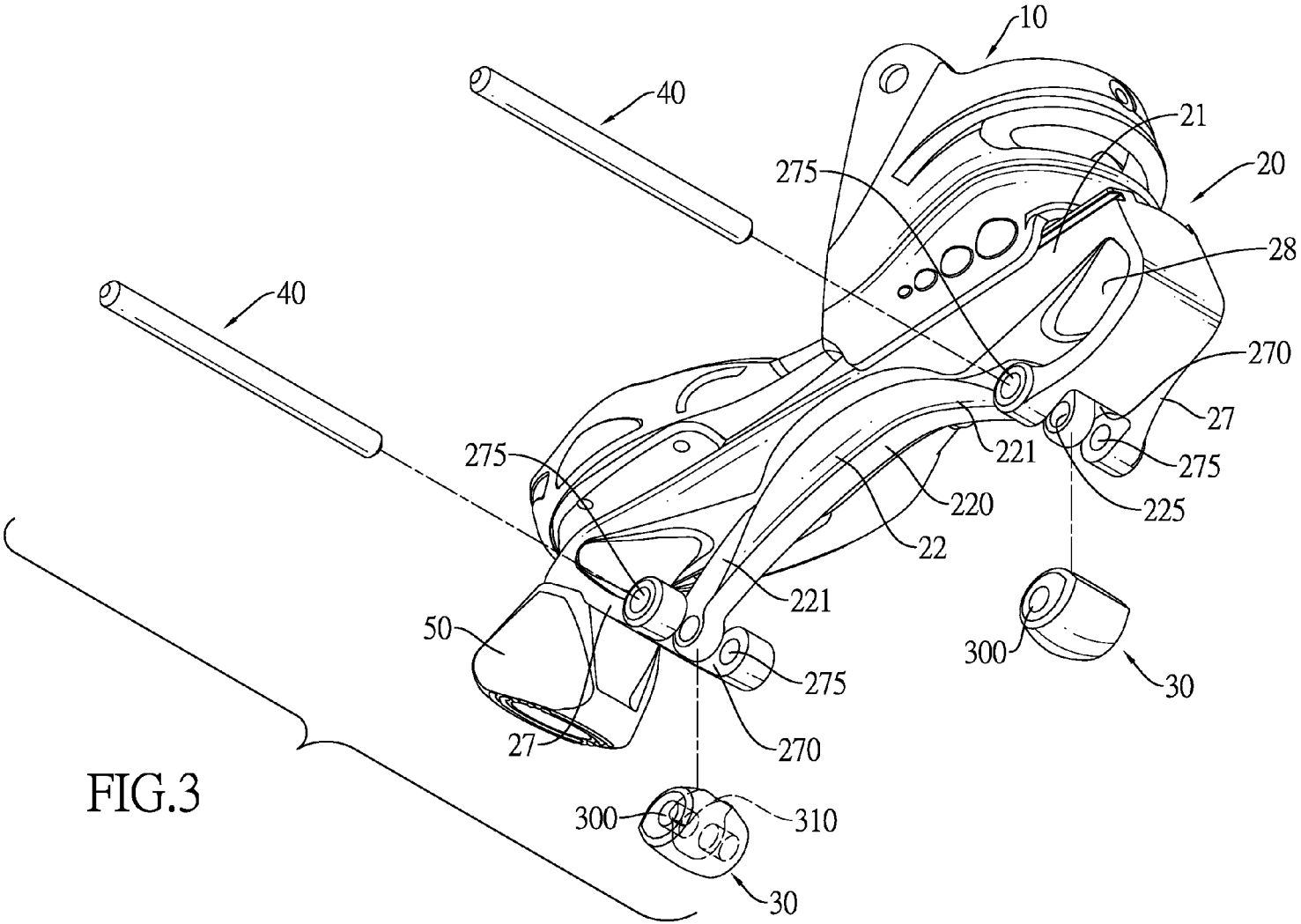
FIG. 3 is an exploded perspective view of the skate sole assembly in FIG. 1.

With reference to FIGS. 1 to 3, a skate sole assembly in accordance with the present invention comprises a boot bracket 10, a frame 20, two cushioning bearings 30 and two axles 40.

The boot bracket 10 may be used to hold a boot and has a bottom.

Figure 4:
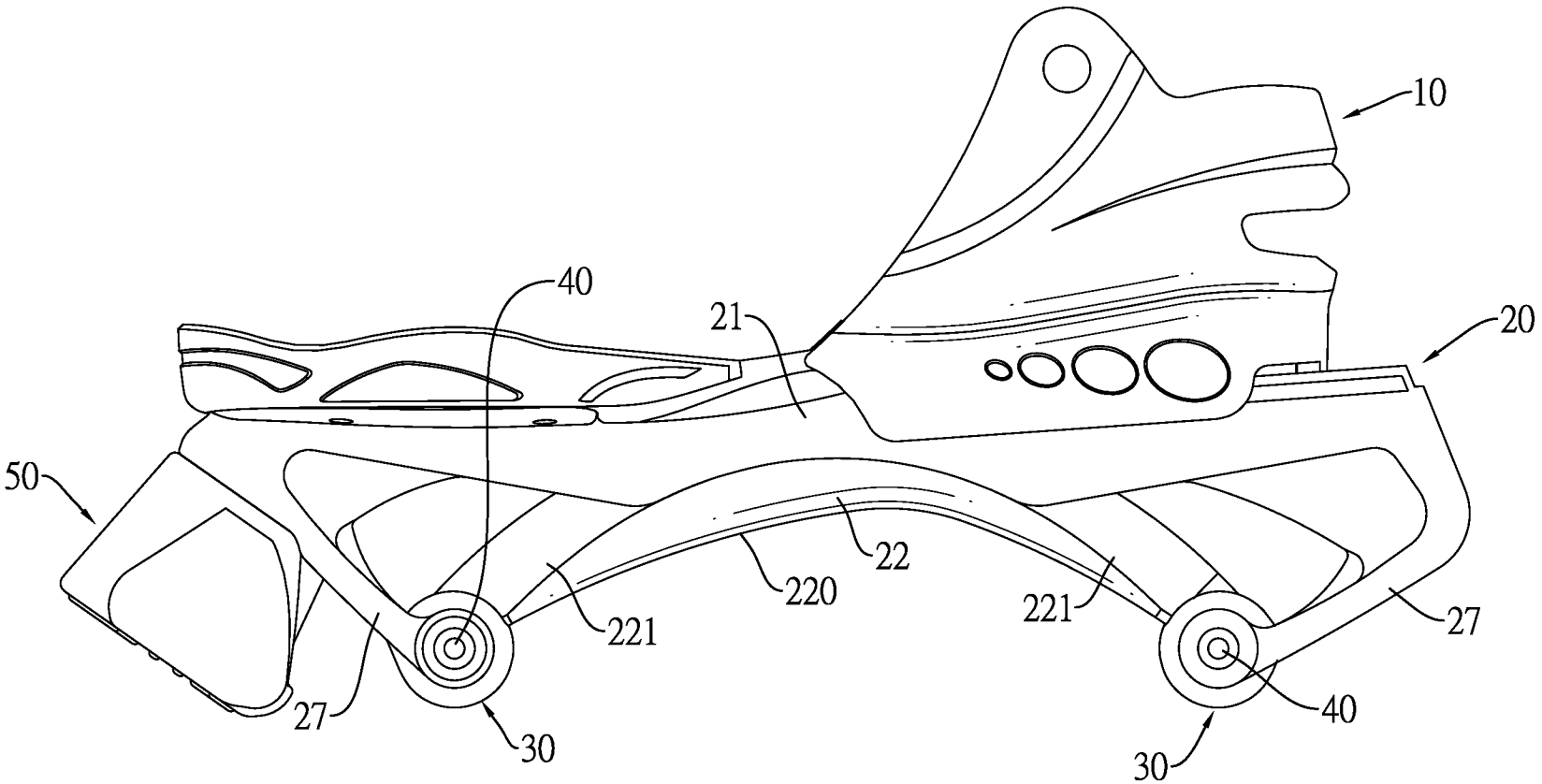
FIG. 4 is a side view of the skate sole assembly in FIG. 1.
Figure 5:
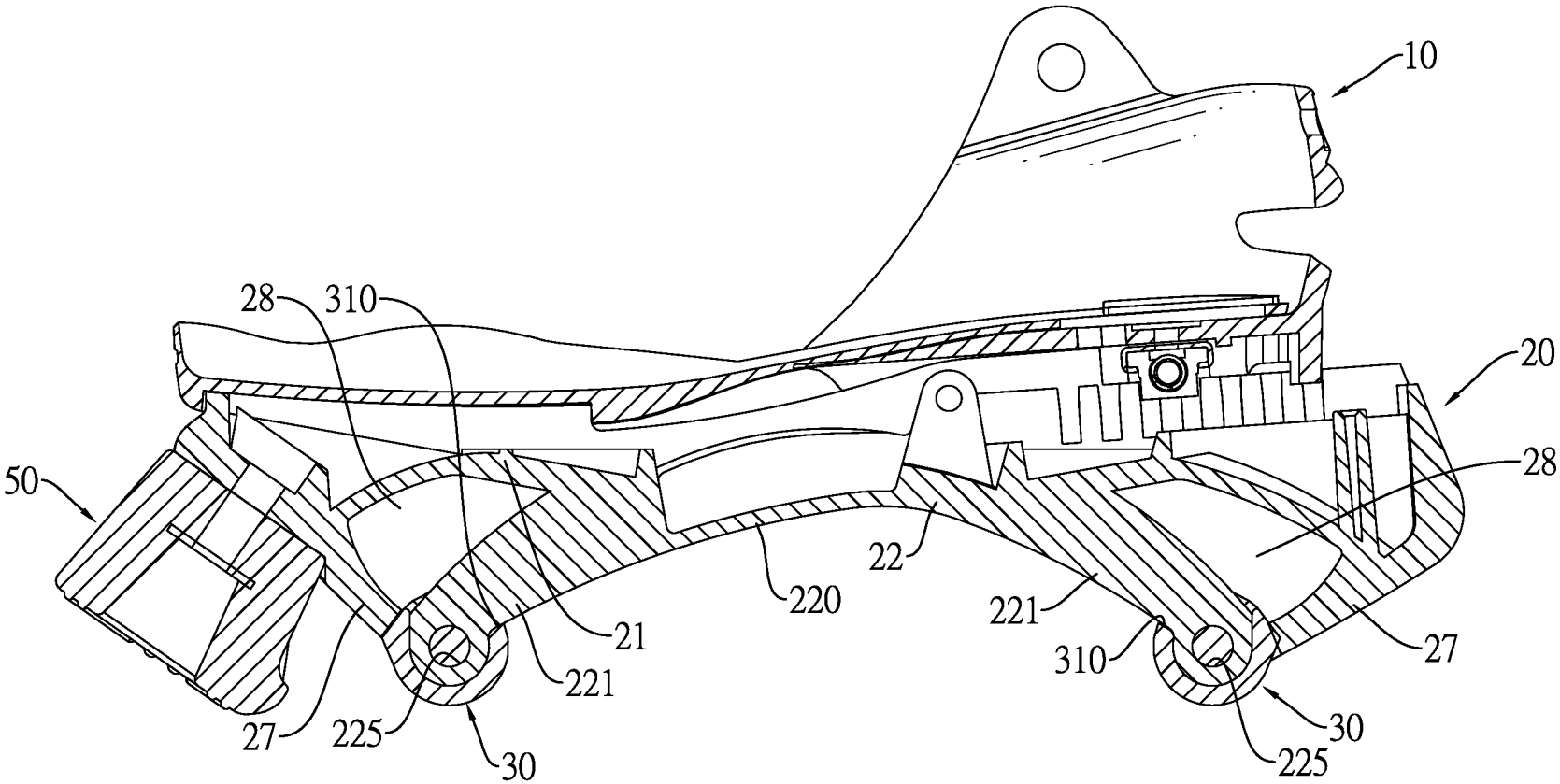
FIG. 5 is a cross sectional side view of the skate sole assembly in FIG. 4.

With further reference to FIGS. 4 and 5, the frame 20 is mounted on the bottom of the frame 10, is made of rigid material such as metal or plastic and has a mounting board 21, an arcuate plate 22, two outer supporting arms 27 and a braking element 50.

The mounting board 21 is mounted on the bottom of the boot bracket 10 and has a bottom surface.

The arcuate plate 22 formed on the bottom surface of the mounting board 21 and has a bottom, a concave surface 220 and two inner supporting arms 221. The concave surface 220 is formed on the bottom of the arcuate plate 22 and faces opposite to the boot bracket 10. The inner supporting arms 221 are formed on the arcuate plate 22 and extend obliquely downward away from each other. Each inner supporting arm 221 has a connecting end having a through hole 225 defined through the connecting end.

The outer supporting arms 27 are formed on the bottom surface of the mounting board 21 and extend obliquely downward toward each other with the inner supporting arms 221 located between the outer supporting arms 27. Each outer supporting arm 27 has a connecting end having an assembling hole 275 and a mounting slot 270. The assembling hole 275 is defined through the connecting end of the outer supporting arm 27. The mounting slot 270 is defined in the connecting end of the outer supporting arm 27 and communicates with the assembling hole 275.

The braking element 50 is mounted securely on a front end of the frame 20.

Figure 6:
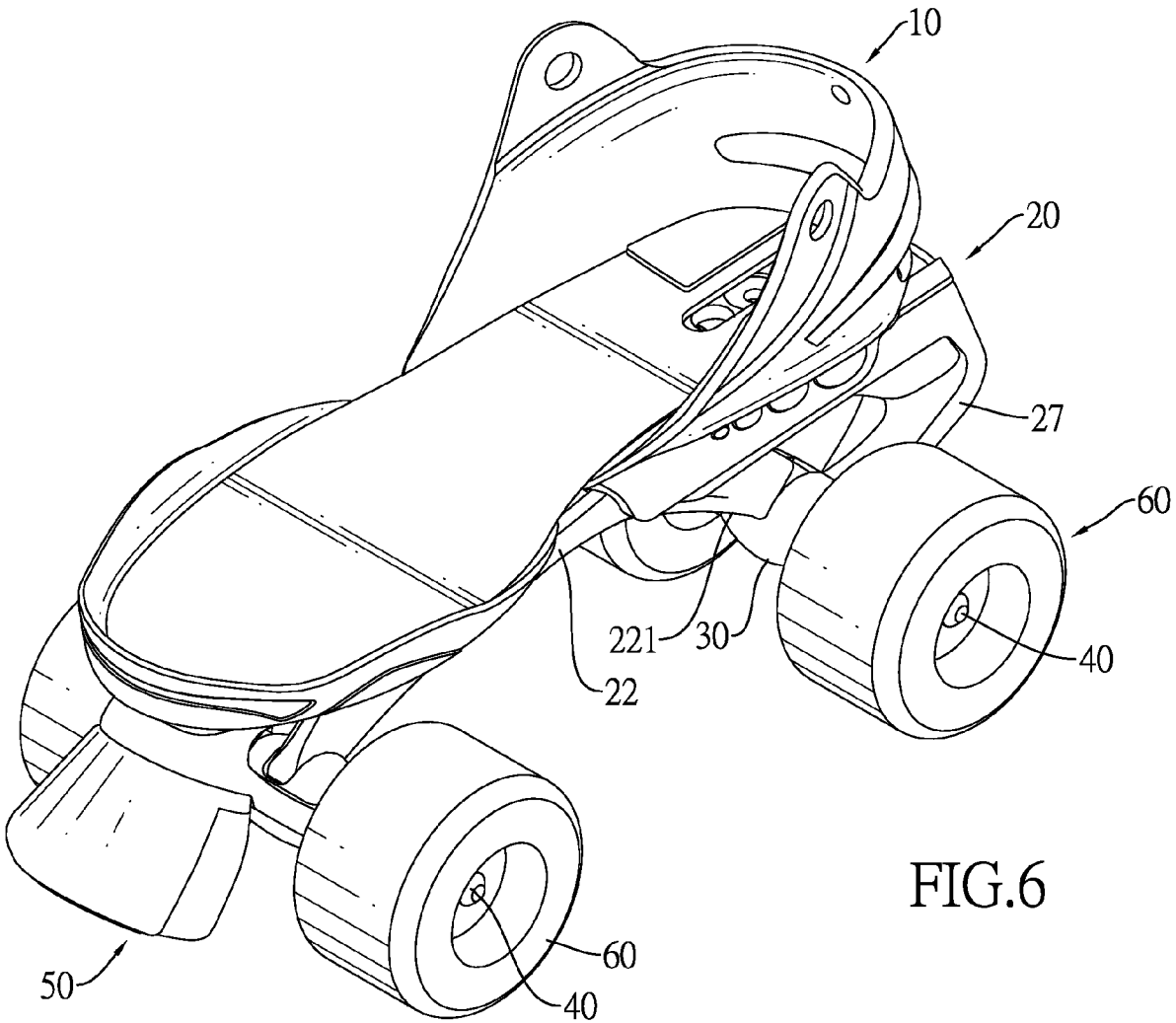
FIG. 6 is an operational perspective view of the skate sole assembly in FIG. 1 mounted with wheels.
Figure 7:
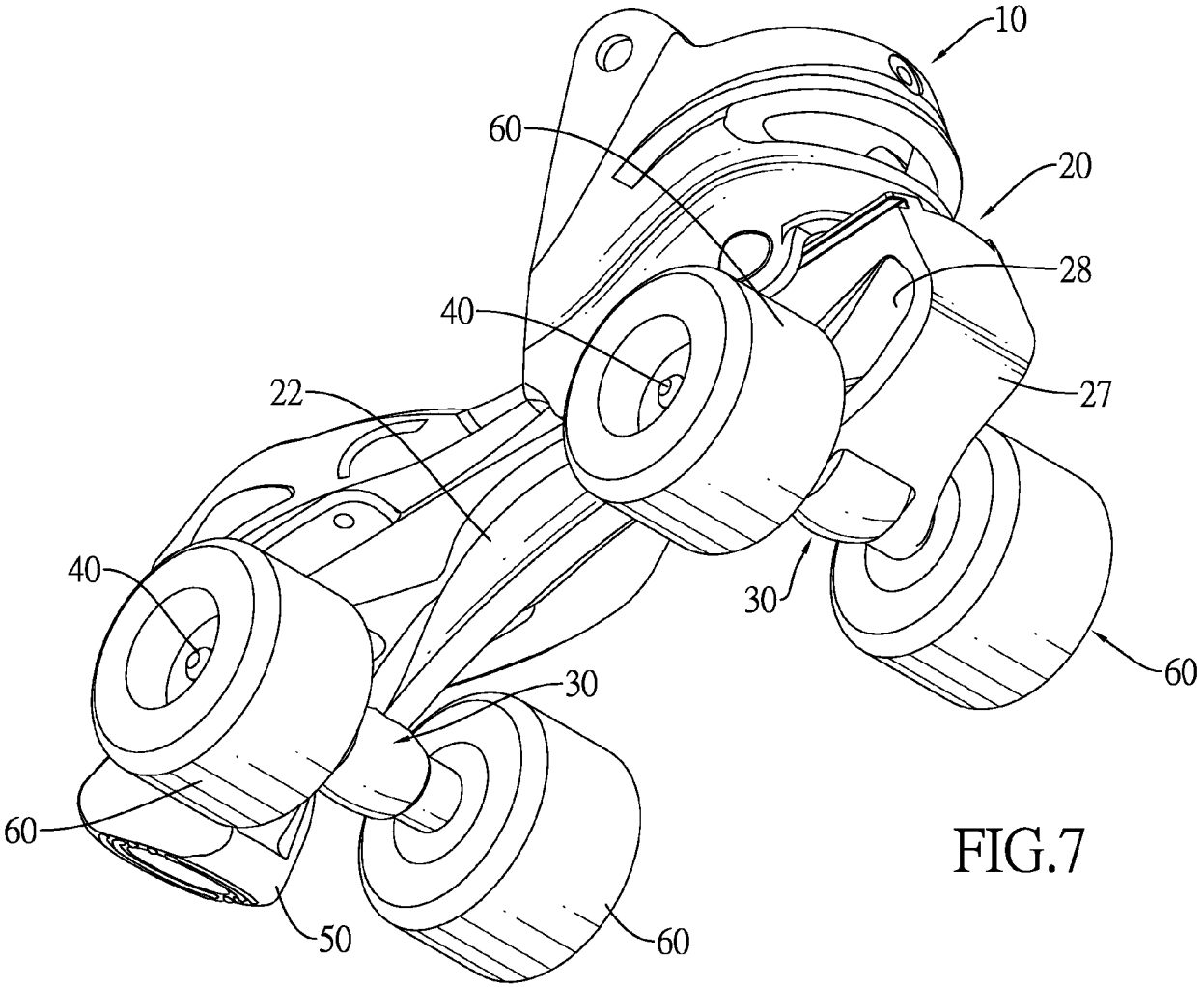
FIG. 7 is another perspective view of the skate sole assembly and the wheels in FIG. 6.
Figure 8:
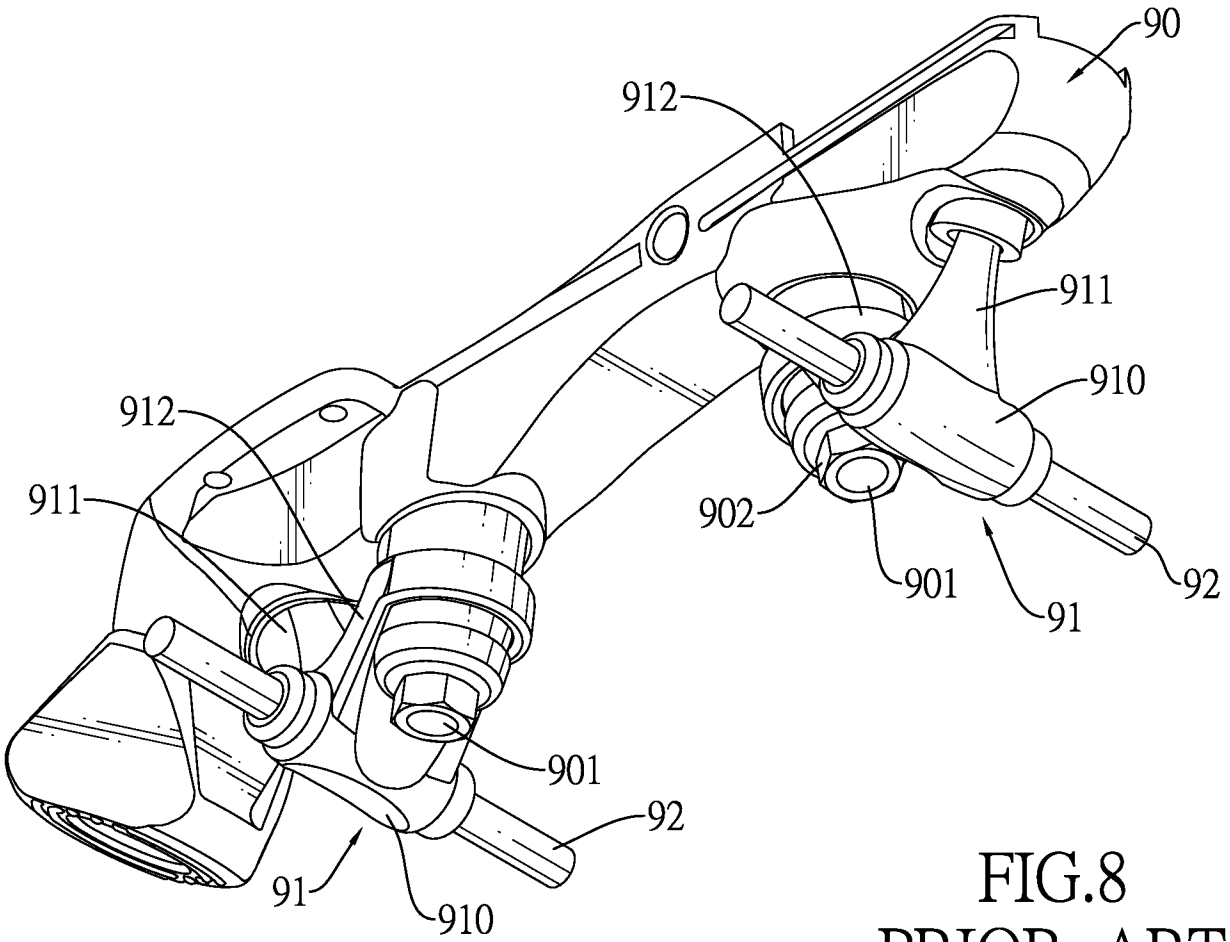
FIG.8 PRIOR ART
FIG. 8 is a perspective view of a conventional skate sole assembly in accordance with the prior art.

With further reference to FIGS. 6 and 7, the cushioning bearings 30 are made of resilient material such as rubber, are embedded respectively in the mounting slots 270 of the outer supporting arms 27, are connected respectively to the connecting ends of the inner supporting arms 221 and each cushioning bearing 30 has an axle hole 300 and an assembling slot 310.

The axle hole 300 is defined through the cushioning bearing 30.

The assembling slot 310 is defined in the cushioning bearing 30, communicates with the axle hole 300 and engages the connecting end of one of the inner supporting arms 221. Thus, the through hole 225 of each inner supporting arm 221 aligns with the assembling hole 275 of a corresponding outer supporting arm 27 and the axle hole 300 of a corresponding cushioning bearing 30.

The axles 40 correspond to the inner supporting arms 221, the outer supporting arms 27 and the cushioning bearings 30. Each axle 40 is mounted rotatably through the through hole 225 of a corresponding inner supporting arm 221, the assembling hole 275 of a corresponding outer supporting arm 27 and the axle hole 300 of a corresponding cushioning bearing 30. Furthermore, each axle 40 may be mounted with two wheels 60 respectively on the ends of the axle 40.

As mentioned above, the connecting ends of the inner supporting arms 221 are embedded and covered respectively in assembling slots 310 of the cushioning bearings 30, the cushioning bearings 30 are embedded and covered respectively in the mounting slots 270 of the outer supporting arms 27 so that the inner supporting arms 221 are connected indirectly to the outer supporting arms 27 through the cushioning bearings 30. The cushioning bearings provide cushioning effects between the inner supporting arms 221 and the outer supporting arms 27.

In a preferred embodiment, a cushioning space 28 is defined between the mounting board 22, one of the inner supporting arms 221 and one of the outer supporting arms 27 to improve the cushioning effect.

The present invention has the following advantages.

1. The mounting board 21, arcuate plate 22, inner supporting arms 221 and outer supporting arms 27 are made of rigid material which does not easily deform. When a user wearing a pair of skates employing the skate sole assemblies skates, moves and turns on variety of ground conditions, stress that is applied on the outer supporting arms 27 and the inner supporting arms 221 causes the outer supporting arms 27 and the inner supporting arms 221 to deform, to move along the axle 40 and to press against the cushioning bearings 30. Then the cushioning bearings 30 bounce the outer supporting arms 27 and the inner supporting arms 221 to their original positions, and the user is returned to go forward straightly. The wheels 60 on the axles 40 do not easily shift, skid or deviate from an original path because the frame 20 does not deform easily.

2. The connecting ends of the inner supporting arms 221, connecting ends of the outer supporting arms 27 and cushioning bears 30 are embedded and combined with one another so that the cushioning bears 30 are mounted between the inner supporting arms 221 and outer supporting arms 27 to provide the cushioning effect to absorb and mitigate the vibration from the axles 40 and wheels 60. Therefore, the user can be protected from injury otherwise occurring when the skates encounter external impact.

3. The cushioning spaces 28 defined by the mounting board, inner supporting arms 221 and outer supporting arms 27 improve the cushioning effect.

4. The concave surface of the arcuate plate 22 makes the arcuate plate slightly resilient to provide the cushioning effect.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A skate sole assembly comprising:

a boot bracket having a bottom;

a frame mounted on the bottom of the frame, made of rigid material and having a mounting board mounted on the bottom of the boot bracket and having a bottom surface;

an arcuate plate formed on the bottom surface of the mounting board and having a bottom;

a concave surface formed on the bottom of the arcuate plate and facing opposite to the boot bracket; and two inner supporting arms formed on the arcuate plate and extending obliquely downward away from each other, and each inner supporting arm having a connecting end having a through hole defined through the connecting end; and two outer supporting arms formed on the bottom surface of the mounting board and extending obliquely downward toward each other with the inner supporting arms located between the outer supporting arms, and each outer supporting arm having a connecting end having an assembling hole defined through the connecting end of the outer supporting arm; and a mounting slot defined in the connecting end of the outer supporting arm and communicating with the assembling hole;

two cushioning bearings made of resilient material, embedded respectively in the mounting slots of the outer supporting arms, connected respectively to the connecting ends of the inner supporting arms and each cushioning bearing having an axle hole defined through the cushioning bearing; and an assembling slot defined in the cushioning bearing, communicating with the axle hole and engaging the connecting end of one of the inner supporting arms; and two axles corresponding to the inner supporting arms, the outer supporting arms and the cushioning bearings and each axle mounted rotatably through the through hole of a corresponding inner supporting arm, the assembling hole of a corresponding outer supporting arm and the axle hole of a corresponding cushioning bearing;

wherein the connecting ends of the inner supporting arms are embedded and covered respectively in assembling slots of the cushioning bearings, the cushioning bearings are embedded and covered respectively in the mounting slots of the outer supporting arms so that the inner supporting arms are connected indirectly to the outer supporting arms through the cushioning bearings.

2. The skate sole assembly as claimed in claim 1, wherein a cushioning space is defined between the mounting board, one of the inner supporting arms and one of the outer supporting arms.

3. The skate sole assembly as claimed in claim 1, wherein a braking element is mounted securely on a front end of the frame.

4. The skate sole assembly as claimed in claim 2, wherein a braking element is mounted securely on a front end of the frame.

* * * * *